United States Patent [19]

Clemens

[11] 4,137,820

[45] Feb. 6, 1979

[54] AMMUNITION HANDLING AND LOADING SYSTEM

[75] Inventor: John E. Clemens, Xenia, Ohio

[73] Assignee: Tesseract Corporation, Tallahasee, Fla.

[21] Appl. No.: 858,992

[22] Filed: Dec. 9, 1977

[51] Int. Cl.[2] ..... F42B 39/12

[52] U.S. Cl. ..... 89/33 BB; 89/34; 214/301

[58] Field of Search ..... 89/33 A, 33 B, 33 BB, 89/33 BL, 34; 198/482, 576, 606; 214/301

[56] References Cited

U.S. PATENT DOCUMENTS

| | | | |
|---|---|---|---|
| 673,151 | 4/1901 | Aramburu | 198/606 |
| 2,344,443 | 3/1944 | McCord et al. | 86/48 |
| 2,413,316 | 12/1946 | Freeman | 86/48 |
| 2,432,398 | 12/1947 | Edson et al. | 86/48 |
| 2,464,689 | 3/1949 | Jackson | 89/33 BB |
| 2,489,428 | 11/1949 | Mariner | 89/33 BB |
| 2,638,029 | 5/1953 | Boehmer | 86/48 |
| 3,101,647 | 8/1963 | Greene | 89/33 BB |
| 3,601,242 | 8/1971 | Reinemuth | 198/482 |
| 3,618,454 | 11/1971 | Christenson | 89/33 BB |
| 3,696,704 | 10/1972 | Backus et al. | 89/34 |

FOREIGN PATENT DOCUMENTS

| | | | |
|---|---|---|---|
| 2624 of | 1892 | United Kingdom | 89/33 B |

*Primary Examiner*—Stephen C. Bentley
*Attorney, Agent, or Firm*—Dowell & Dowell

[57] ABSTRACT

A handling and loading system for relatively large caliber ammunition used by automatic weapons such as 20 mm to 40 mm rapid fire guns carried by military aircraft. The system includes an apparatus for automatically removing live rounds of ammunition from a belt of indeterminate length having a plurality of individual containers and loading such ammunition into the armament system of the aircraft while simultaneously removing expended shell casings from the aircraft and inserting the same into the containers which can then be returned for reloading.

19 Claims, 13 Drawing Figures

AMMUNITION HANDLING AND LOADING SYSTEM

BACKGROUND OF THE INVENTION

1. Field of the Invention

This invention relates generally to automatic systems for handling a plurality of elongated slender articles and relates particularly to automatic handling and loading systems for large caliber ammunition used by military aircraft.

2. Description of the Prior Art

Historically military aircraft armament consisted primarily of rapid fire machine guns in which the cartridges were mounted in belts which fed from one ammunition box through the gun to another ammunition box. As military aircraft became more complex with increased speed and payload capacity, 20 mm and 30 mm cannon and rockets were added to the armament system. However, only a few rockets could be accommodated and the cannon had a relatively slow rate of fire and, therefore, a large ammunition capacity was not needed.

The technology of aircraft armament systems continued to increase and the rate of fire of the cannon rose significantly until General Electric Company developed the GAU-8/A 30 mm Gatling type gun for use with the U.S. Air Force A-10 Close Air Support Aircraft. This gun and the accompanying armament system has an ammunition capacity of approximately 1350 rounds which can be fired at a rate of up to approximately 4200 shots per minute. Because of such capacity and rate of fire, a substantial problem has arisen in reloading the armament system in a minimum amount of time since the spent casings or shells must be removed from the aircraft armament system and either simultaneously or subsequently the armament system must be replenished with live rounds. Further, it is frequently necessary to fuel and rearm an aircraft after one sortie so that the aircraft is ready to fly another mission in a minimum amount of time. The fuel tanks of the aircraft can be filled in a few minutes; however, due to the size and weight of the ammunition, it has required a crew of approximately four men several hours to rearm the aircraft if the armament system is substantially depleted. Similar armament systems using 20 mm and 40 mm ammunition have been provided for other military aircraft; however, the problem of rearming the planes in a minimum of time has continued to exist.

Some efforts have been made to alleviate the problems of replenishing the armament systems of military aircraft such as the patent to Backus et al. U.S. Pat. No. 3,696,704 which has been assigned to General Electric Company. Although the structure disclosed in this patent reduced the time and effort required to load and/or unload (upload and/or download) the aircraft, the time required was still in excess of the time required to supply fuel. Accordingly, at times the aircraft has been detained for the sole purpose of receiving a full complement of ammunition.

Other efforts have been made to provide machines for inserting rounds of ammunition into an ammunition belt of the permanent, linked, or disintegrating types, such as disclosed in the patents to McCord et al. U.S. Pat. Nos. 2,344,443; Freeman, 2,413,316; Edson et al. 2,432,398; and Boehmer 2,638,029. However, most of these structures have included one or more hoppers which feed ammunition onto a conveyor belt and such ammunition is moved axially onto an ammunition belt by a series of push rods.

SUMMARY OF THE INVENTION

The present invention is embodied in an apparatus for handling elongated slender articles and particularly in an ammunition handling apparatus in which relatively large caliber rounds of ammunition (normally 20 mm to 40 mm) are removed from individual storage containers or tubes and placed on a cradle conveyor where they remain in spaced parallel relationship with each other as they advance through the apparatus. A feed conveyor intercepts the rounds of ammunition on the cradle conveyor and removes the same therefrom. The feed conveyor automatically transfers or uploads such rounds to the armament system of an aircraft, while simultaneously empty shell casings and misfired rounds are removed or downloaded from the aircraft. The empty shell casings are inserted into the storage containers from which the live rounds were removed and the duds or misfired rounds are either discharged into a separate container or are inserted into the storage containers. The storage containers form part of a selectively separable belt of indeterminate length which ordinarily includes approximately 450 rounds carried in an ammunition box. As containers with live rounds therein are being removed from one ammunition box, containers having empty shell casings therein are being inserted into an adjacent box. Experiments indicate that the full complement of the aircraft system can be uploaded and/or downloaded in approximately the same time that is required to completely refuel the aircraft.

Normally the containers are filled with live ammunition and are placed in ammunition boxes at a factory or depot and the boxes containing empty shell casings are returned to the factory for reloading. Hence, it is not necessary to manually handle the ammunition at a military airfield or a naval aircraft carrier. Also, live ammunition of 20 mm to 40 mm caliber usually is placed in protective cardboard tubes at an ammunition factory and must be manually removed from such protective tubes prior to insertion into the aircraft armament system. After the rounds of ammunition have been removed, disposal of the protective tubes and other dunnage has presented a substantial problem.

It is an object of the invention to provide an apparatus for handling elongated slender articles in which the articles are removed from containers and placed on a first conveyor from which the articles are removed by a second conveyor and transferred to a ready storage system.

Another object of the invention is to provide an ammunition handling system in which rounds of ammunition are removed from containers which are normally stored in an ammunition box, and such rounds are placed on a first conveyor from which they are automatically removed by a second conveyor which transfers the rounds to the armament system of a military aircraft ready for use. Simultaneously, the empty shell casings and misfired rounds of ammunition are removed from the armament system of the aircraft and the casings are inserted into the containers from which the live rounds were removed, while the misfired rounds are either discharged into a dud storage compartment or are returned to the containers after which the containers are returned to an ammunition box.

A further object of the invention is to provide an ammunition handling system which can upload a partial or full complement of live rounds to the armament system of an aircraft and simultaneously download empty shell casings in a minimum of time.

A still further object of the invention is to provide an ammunition handling sytem in which live rounds of ammunition are placed within containers at an ammunition depot or plant and such containers are stored in ammunition boxes from which the containers are automaticaly removed so that the ammunition may be inserted into the armament system of an aircraft while empty casings from the aircraft are returned to the containers which are then returned to an ammunition box so that disposal of live round dunnage and empty shell casings ceases to be a problem.

DESCRIPTION OF THE PREFERRED EMBODIMENT

Figure 1:
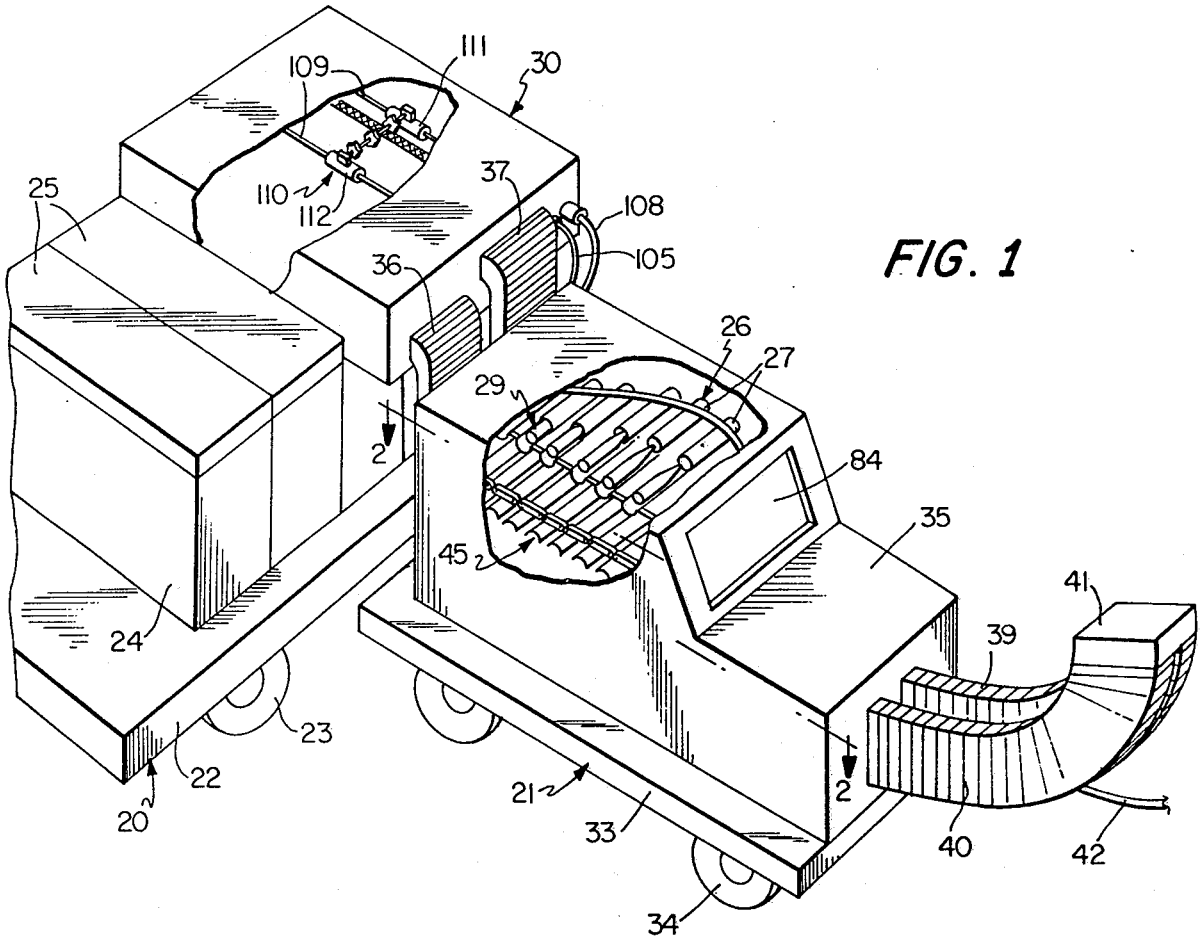
FIG. 1 is a perspective view with portions broken away and illustrating one application of the invention.
Figure 8:
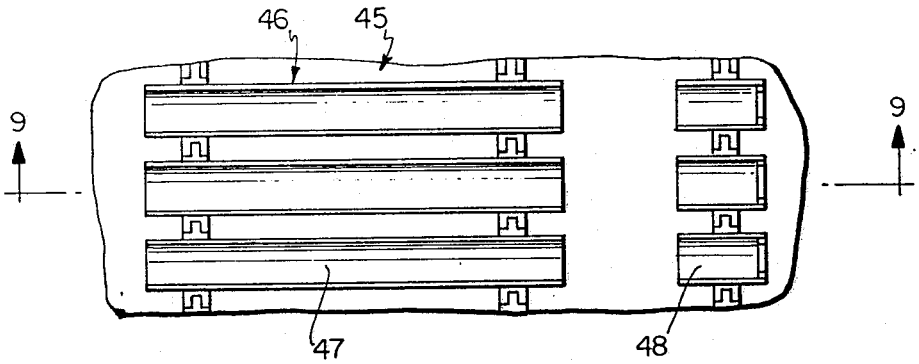
FIG. 8 is an enlarged fragmentary top plan view of the cradle conveyor.

With continued reference to the drawings, an ammunition handling and loading system for a military aircraft may include a transport vehicle 20 and an ammunition transfer vehicle 21 which are adapted to be arranged in adjacent relationship; however, it is contemplated that the handling and loading system could be mounted on a single vehicle. The transport vehicle 20 includes a platform or bed 22 mounted on wheels 23 and such vehicle supports several ammunition boxes or containers 24 each of which has a removable top or cover 25. As illustrated in FIG. 1, four ammunition boxes 24 are carried by the vehicle 20 and, at the beginning of operation, three of such boxes contain elongated belts 26 of indeterminate length with each belt having a multiplicity of generally cylindrical tubes or sleeves 27 releasably connected together in any desired manner, as by a plurality of webs 28. A round of ammunition 29 is stored in each of the tubes. The webs are releasably connected to each of the tubes in such a manner that a predetermined number of tubes may be removed from the ammunition box so that a desired number of rounds of ammunition 29 may be loaded into the aircraft armament system.

The present apparatus will be described with a system for handling and loading 30 mm ammunition into a military aircraft having a GAU-8A armament system; however, other armament systems, such as armament systems using 20 mm to 40 mm ammunition, for example, could be used merely by modifying the sizes of the component parts.

In the present instance, three of the ammunition boxes 24 carry elongated belts 26 each having 450 tubes so that three boxes carry sufficient ammunition to completely load an armament system of an aircraft having a capacity of 1350 rounds. The fourth ammunition box normally is empty at the beginning of operations and provides a receptacle for a belt 26 after the ammunition has been removed from the tubes and empty shell casings from the aircraft armament system have been inserted therein in a manner which will be described later. The transport vehicle 20 may be propelled in any desired manner (not shown) including by a self-contained power plant or by an elongated tongue which can be pulled by a propelling vehicle or by several people.

With particular reference to FIGS. 1 and 11–13, a belt handling apparatus 30 is provided which is of a size to be mounted on two of the ammunition boxes 24 after the covers have been removed therefrom. One side of the belt handling apparatus includes a sprocket mechanism 31 which is used for removing a belt 26 from a first ammunition box and the other side of the belt handling apparatus is provided with a flaker mechanism 32 which inserts a belt 26 into a second ammunition box in a manner to be described later.

Figure 3:
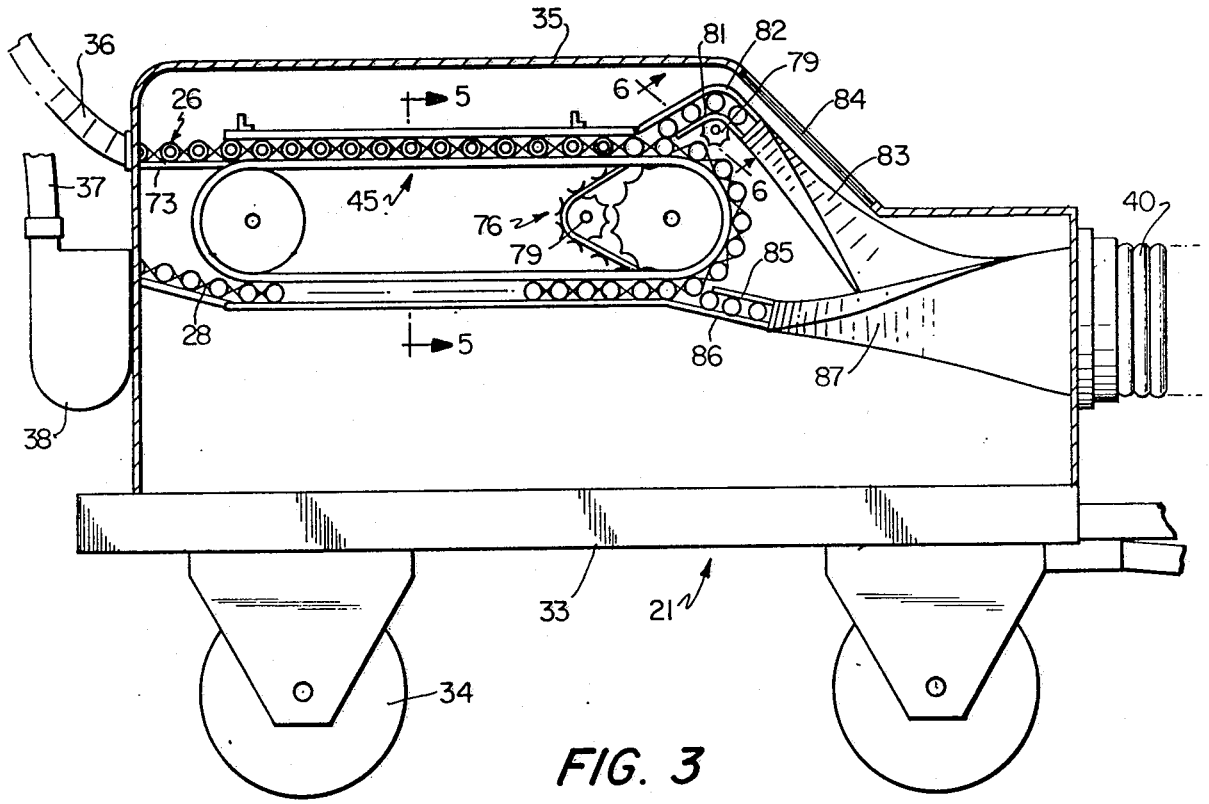
FIG. 3 is a section on the line 3—3 of FIG. 2.

The ammunition transfer vehicle 21 includes a platform or bed 33 carried by wheels 34. A housing 35 is mounted on the platform 33 and such housing has a pair of flexible chutes 36 and 37 which connect one end of the housing to the belt handling apparatus 30. The flexible chute 37 is attached to a surge chamber 38, FIG. 3, carried by the housing 35 for a purpose which will be described later. The opposite end of the housing 35 is provided with a pair of flexible chutes 39 and 40 which connect the housing 35 to an interface or load head unit 41 which is adapted to be removably attached to the aircraft armament system. The interface unit 41 is positioned in abutting relationship with a cooperating conventional interface unit which is part of the aircraft armament system so that ammunition can be automatically transferred from the system of the present invention to the aircraft armament system and, simultaneously, spent casings and unfired rounds or duds are transferred from the aircraft armament system to the handling system of the present invention.

Preferably a flexible drive shaft 42 is carried by the transfer vehicle 21 and one end of such shaft is adapted to be connected to a power takeoff from the armament system power plant of the aircraft and the other end of such drive shaft is connected to a gear box or transmission 43 on the transfer vehicle so that the aircraft supplies the source of power for operating the mechanisms of the ammunition transfer vehicle 21 and the transport vehicle 20. It is contemplated that the drive shaft 42 could be driven by any other convenient source of power, including a power plant carried by either vehicle.

Figure 7:
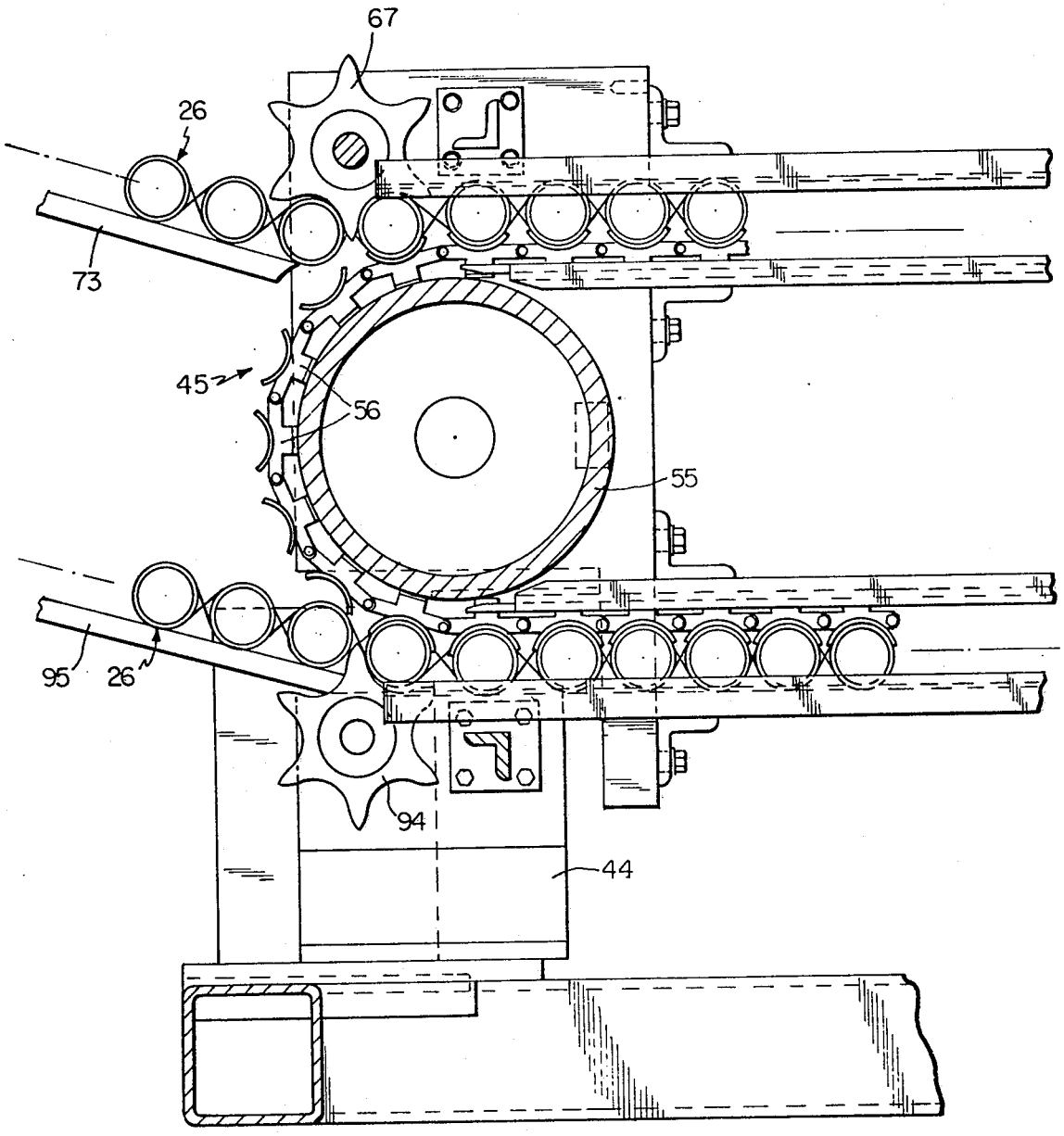
FIG. 7 is an enlarged fragmentary section on the line 7—7 of FIG. 2.

The housing 35 is provided with a frame 44 on which a cradle conveyor 45 having a multiplicity of split cradles 46 is rotatably mounted. Each of such cradles is generally arcuate in cross-section and includes an elongated section 47 and a short section 48 which are spaced apart a predetermined distance. The elongated sections 47 are mounted in generally parallel relationship with each other on a pair of spaced conveyor chains 49 and 50, while the short sections are mounted in parallel relationship with each other on a conveyor chain 51. The conveyor chains 49, 50 and 51 are driven by a plurality of drive sprockets 52 adjustably mounted on a drive shaft 53 at one end of the conveyor and such drive shaft is drivingly connected to gearing (not shown) located within the gear box 43. The gearing within such gear box drivingly connects the drive shaft 53 to the flexible drive shaft 42 so that the drive sprockets 52 are driven by the power plant of the aircraft. It is essential for the drive sprockets 52 to be synchronized with each other so that the elongated sections 47 of the split cradles are in axial alignment with the short sections 48. At the opposite end of the cradle conveyor, the conveyor chains 49, 50 and 51 extend around an idler roller or a plurality of idler sprockets 55 (FIG. 7).

Figure 10:
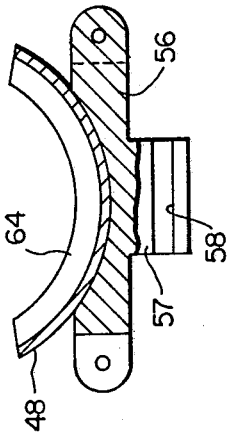
FIG. 10 is an enlarged section on the line 10—10 of FIG. 9.

Each of the conveyor chains includes a plurality of links 56 pivotally connected by pivot pins at opposite ends to adjacent links to form an endless chain. Each link includes an inwardly extending lug 57 having grooves 58 (FIG. 10) on opposite sides which receive upper and lower tracks or guideways 59 and 60, respectively. The cradle sections 47 ad 48 are welded or otherwise fixed to the outer portions of the links 56.

Figure 5:
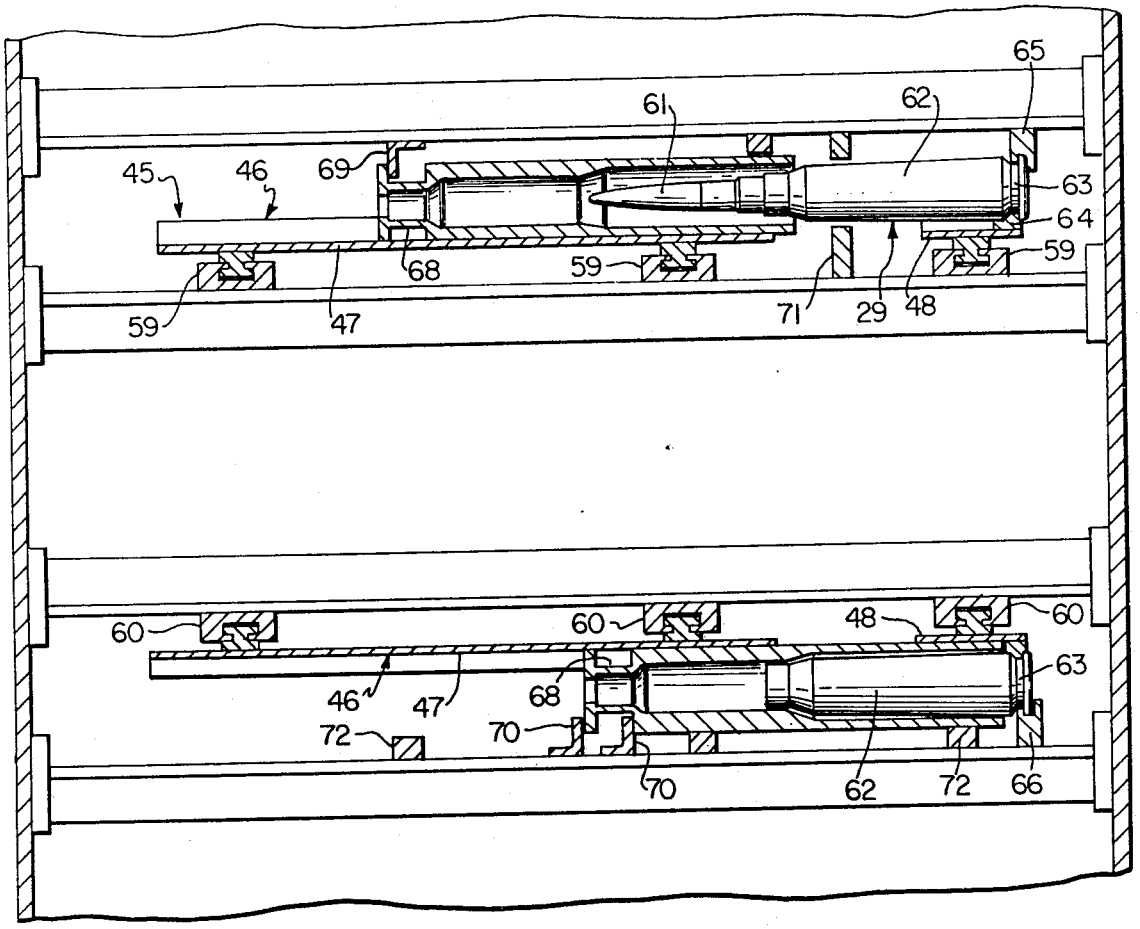
FIG. 5 is an enlarged fragmentary section on the line 5—5 of FIG. 3.
Figure 9:
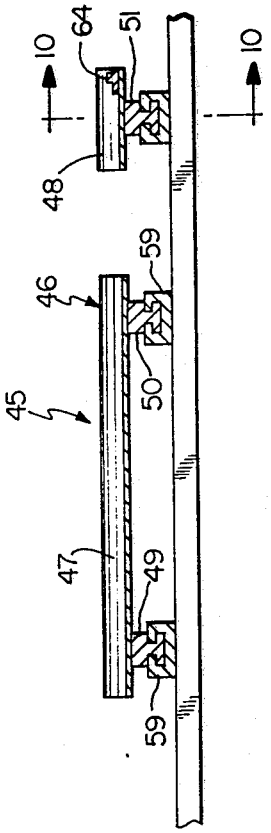
FIG. 9 is a section of the line 9—9 of FIG. 8.
Figure 11:
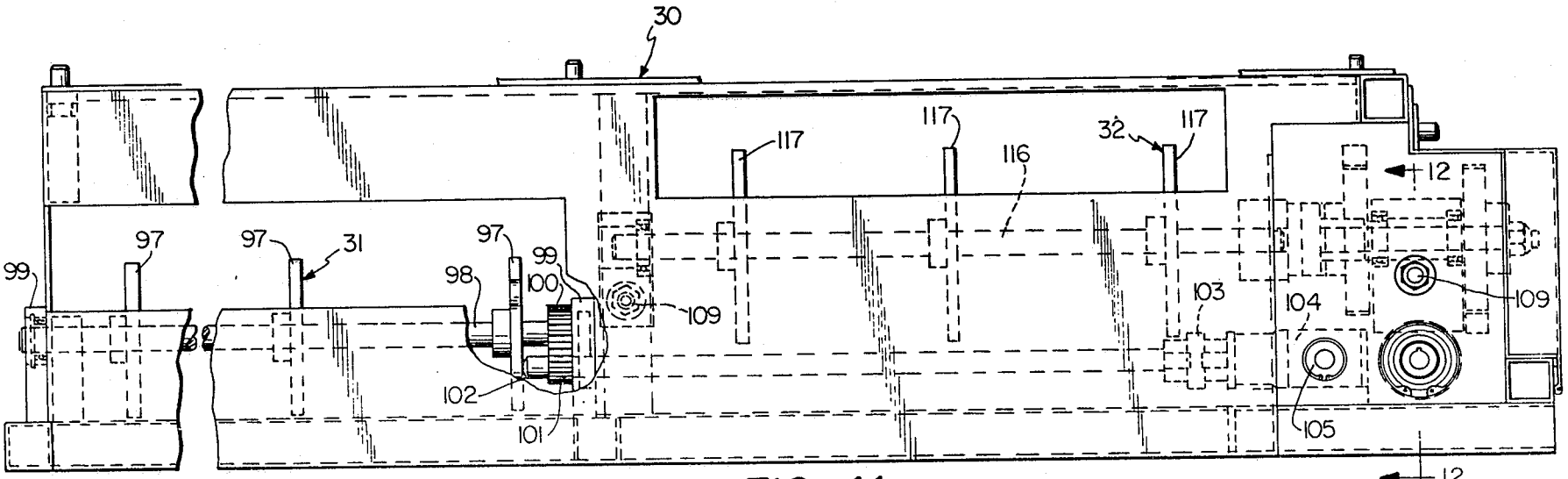
FIG. 11 is a front elevational view of the belt handling mechanism.
Figure 12:
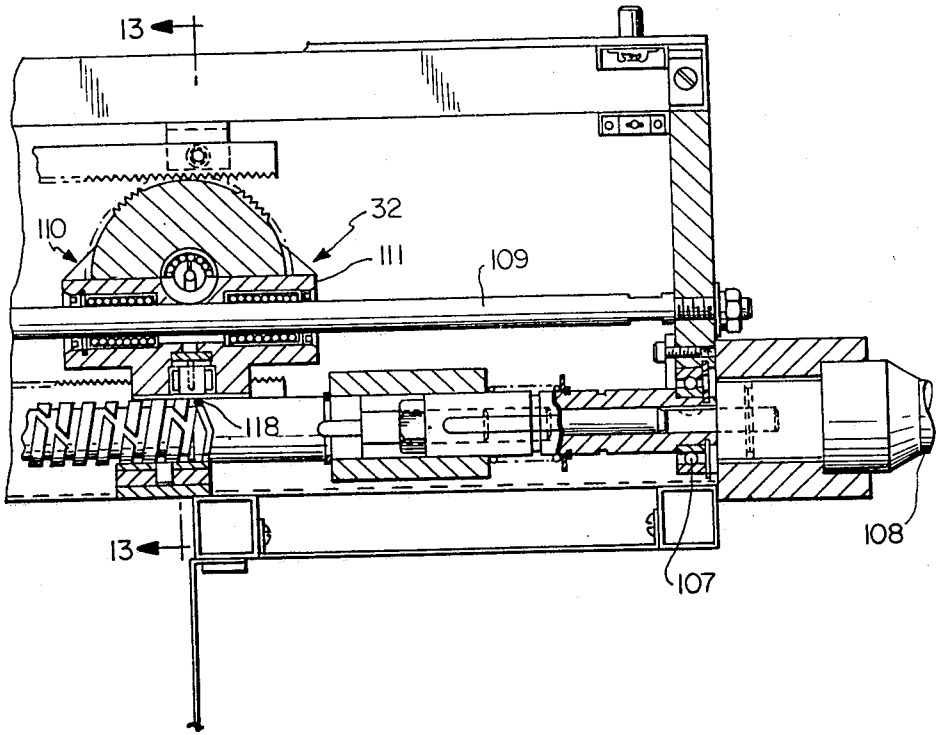
FIG. 12 is a section on the line 12—12 of FIG. 11.
Figure 12:
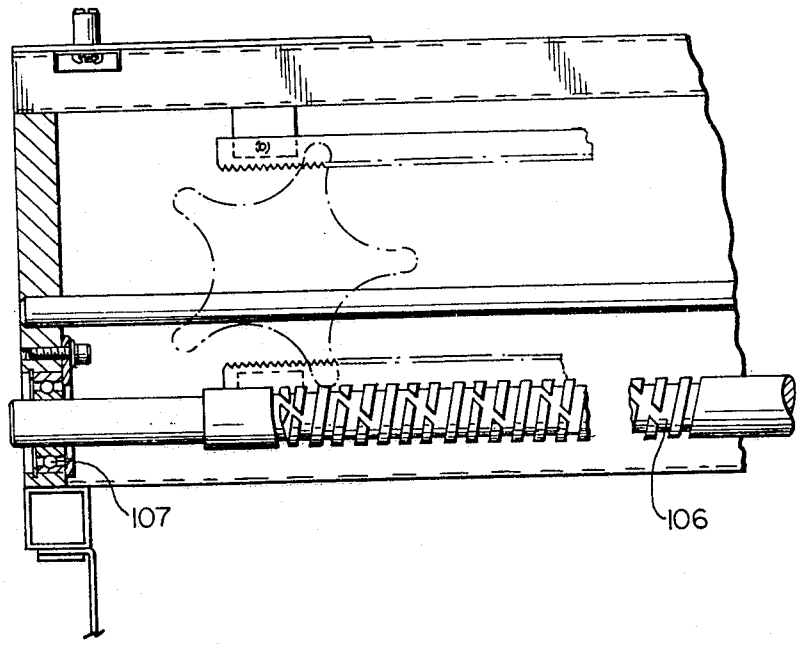
Figure 13:
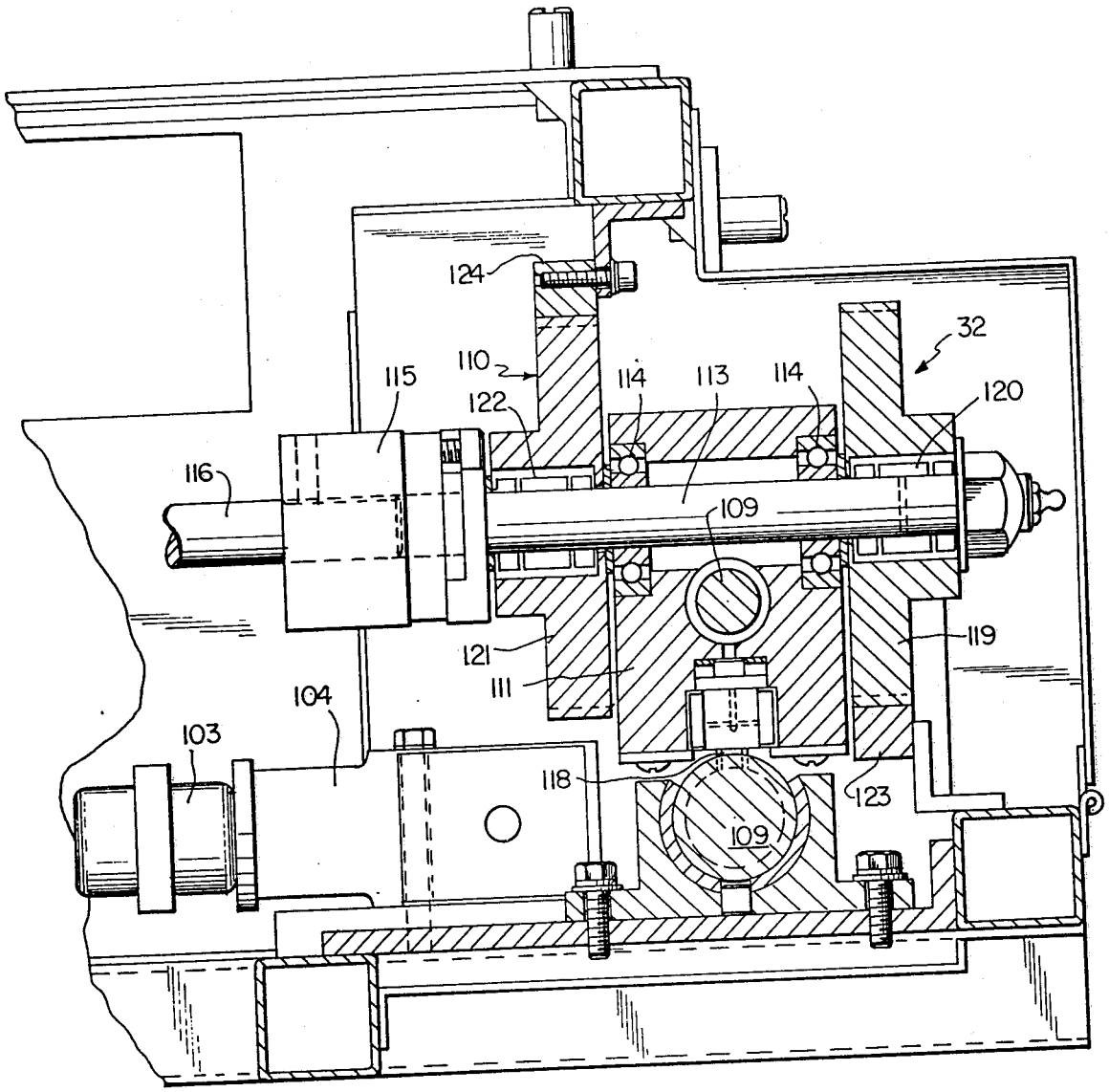
FIG. 13 is an enlarged fragmentary section on the line 13—13 of FIG. 12.

With particular reference to FIG. 5, each live round of ammunition 29 includes a projectile 61 mounted in a reduced neck of a casing 62 having an extractor groove 63 located adjacent to the butt end. The reduced neck of the casing engages a reduced diameter bore within the tubes 27 to position the round of ammunition so that the butt end of the casing is disposed outwardly of the tube. As illustrated best in FIGS. 5, 9 and 10, each of the short sections 48 of the split cradles includes an upwardly extending arcuate ridge 64 which is received within the extractor groove 63 and such ridge 64 cooperates with fixed upper and lower guides 65 and 66, respectively, to cause the rounds of ammunition to follow a straight path within the housing 35.

When the belt 26 enters the housing 35 through the flexible chute 36, such belt passes along a ramp 73 leading to a star wheel 67 which guides such tubes onto both the elongated sections 47 and the short sections 48 of the split cradles, while the butt portions of the rounds of ammunition 29 are positioned so that the extractor grooves 63 are engaged by the ridges 64. Each of the tubes 27 has an annular groove 68 adjacent the end remote from the butt end of the round of ammunition and such annular groove slidably receives one or more upper cams 69 on the upper run of the cradle conveyor and one or more lower cams 70 on the lower run thereof.

Figure 2:
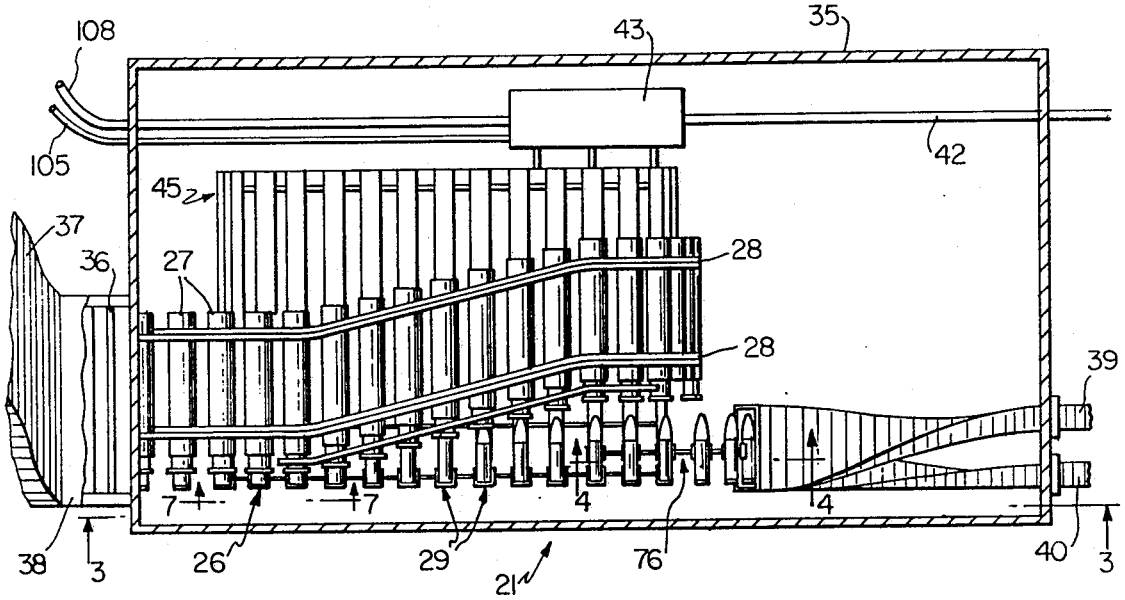
FIG. 2 is an enlarged section on the line 2—2 of FIG. 1.

As illustrated best in FIG. 2, when the belt 26 is moved through the housing 35 by the cradle conveyor 45, the rounds of ammunition 29 follow a straight path due to engagement of the extractor grooves with the ridges 64 of the short sections of the conveyor, while the upper cam 69 engages the groove 68 of each of the tubes 27 and causes such tubes to be shifted axially along the elongated sections 47 of the cradle conveyor until the tubes are removed from the rounds of ammunition. At this time the rounds of ammunition are cantilevered from the ridge 61 and upper guide 65. If desired, upper and lower guide bars 71 and 72 (FIG. 5) may be provided to make certain that the round of ammunition and the tubes 27 remain in the split cradles.

Adjacent to the drive sprockets 52 of the cradle conveyor, a feed conveyor 76 is positioned between the elongated sections 47 and the short sections 48 of the split cradles. The feed conveyor includes a plurality of pivotally connected members 77 each of which has an element 78 of a size and configuration to engage the shell casings 65 of the rounds of ammunition carried by the cradle conveyor 45. The feed conveyor 76 is driven by one or more drive sprockets 79 mounted on drive shafts 80 and such drive shafts are connected to the flexible drive shaft 42 by gearing (not shown) within the gear box 43. The drive sprockets 79 are driven in timed relationship with the drive sprockets 52 of the cradle conveyor so that the elements 78 intercept the rounds of ammunition carried by the cradle conveyor at the time that the upper guide 65 terminates so that the elements 78 automatically remove the rounds of ammunition from the cradle conveyor.

Figure 4:
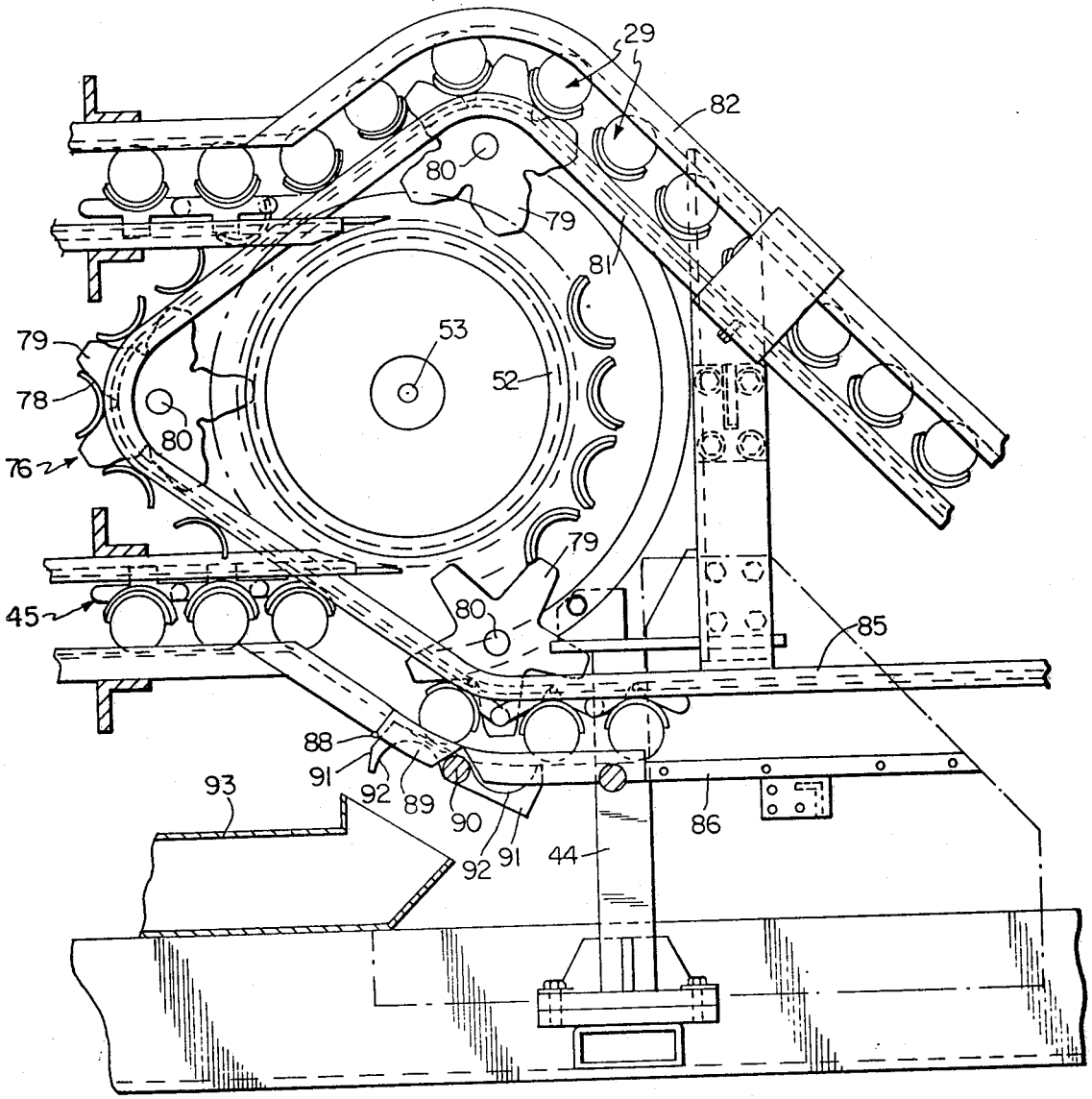
FIG. 4 is an enlarged fragmentary section on the line 4—4 of FIG. 2.
Figure 6:
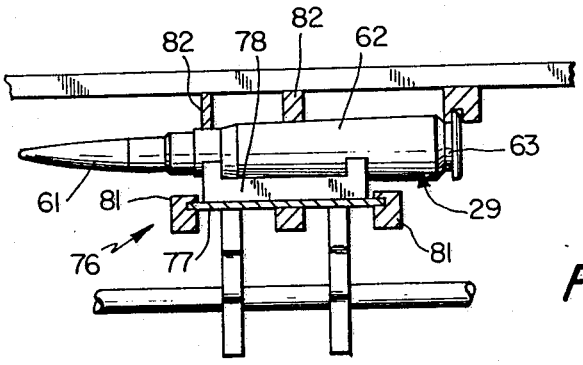
FIG. 6 is an enlarged fragmentary section on the line 6—6 of FIG. 3.

As illustrated best in FIG. 4, the upper run of the feed conveyor 76 is located at an angle to the direction of movement of the cradle conveyor 45 at the point of interception so that the rounds of ammunition change direction of movement slightly in order to lift the rounds of ammunition out of the split cradles 46 of the cradle conveyor. With particular reference to FIG. 6, the members 77 of the feed conveyor preferably are slidably received within a lower guide track 81 and one or more upper hold-down cams 82 are provided to hold the rounds of ammunition within the elements 78. Preferably the hold-down cams 82 either are connected to the ends of the upper guide bars 71 or begin in substantially the same plane that the upper guide 65 and the upper guide bars 71 terminate so that the rounds of ammunition are retained on the elements 78.

After the elements 78 have passed the drive sprockets 79, the guide track 81 and the hold-down cams 82 are twisted so that the rounds of ammunition are rotated substantially 90° to cause the axes of the rounds of ammunition to be disposed along a generally vertical plane. If desired, the twisted portions of the track 81 and the cams 82 may be confined within a flexible chute 83 which leads to the flexible chute 39. Preferably an inspection window 84 is provided in the housing 35 adjacent to the feed conveyor 76 so that the passage of the rounds of ammunition may be observed.

The feed conveyor 76 carries the rounds of ammunition through the flexible chute 39 to the interface or load head unit 41 which is attached to an interface (not shown) of the aircraft armament system. At the interface 41 the rounds of ammunition are transferred from the elements 78 to the aircraft armament system and the elements 78 cross over the interface and return to the housing 35 through the flexible chute 40. Simultaneously, empty shell casings and misfired rounds or duds are transferred from the aircraft armament system to the elements 78 of the feed conveyor 76 within the interface 41. Thereafter the feed conveyor 76 passes through the flexible chute 40 carrying the empty casings and the misfired rounds into the housing 35. Within the housing 35 the members 77 of the lower run of the feed conveyor are guided by an upper track guide 85 (FIG. 4) and by one or more support bars or rods 86 which retain the empty shell casings and the misfired rounds in the elements 78 of the feed conveyor. The guide track 85 and the support bars are twisted within the housing to cause the shell casings to be rotated substantially 90° so that the axes of the casings are disposed along a generally horizontal plane for insertion into the cradle conveyor 45. If desired, the twisted portions of the track guide 85 and the support bars 86 may be covered by a flexible chute 87.

The lower run of the feed conveyor 76 passes between the split cradles on the lower run of the cradle conveyor 45 so that the split cradles intercept the movement of the shell casings and cause such split cradles to remove the shell casings from the feed conveyor.

It may be desirable to remove the misfired rounds from the lower run of the feed conveyor before the misfired round is intercepted by the cradle conveyor. In order to do this, a section of the support bars or rods 86 is separated from the remainder of the support bars and connected thereto by a hinge 88 (FIG. 4). The separated section forms a trap door 89 which normally is locked in a position in alignment with the remainder of such support bars by a selectively operable locking mechanism (not shown). A conventional feeler or other sensor is located adjacent to the lower run of the feed conveyor 76 and positioned so as to permit empty shell casings to pass but to be engaged by the projectile 61 of any misfired round. A selectively rotatable shaft 90 is mounted within the housing 35 below the support bars 86 and such shaft is provided with one or more arms 91 extending outwardly from at least one side thereof and generally normal to the axis of rotation of such shaft. The arm 91 includes a curved recess 92 of a configuration generally complementary to the shell casings 62.

As illustrated, a pair of arms 91 are mounted on opposite sides of the shaft 90 and such shaft is adapted to be selectively rotated from the gear box or transmission 43 by means of a selectively engageable clutch mechanism (not shown). The clutch mechanism is of conventional construction and is adapted to rotate the shaft 90 either one-half or one full revolution depending upon the number of arms 91 carried by the shaft. In the present instance, when the feeler or sensor is engaged by the projectile of a misfired round, the sensor triggers the clutch mechanism and causes the shaft 90 to rotate and simultaneously unlatches the trap door 89.

When the shaft 90 is rotated, the arm 91 likewise is rotated so that the recess 92 engages the misfired round of ammunition and removes such round from the element 78 and discharges the misfired round through the trap door 89 into an armored compartment 93 located below the same. After the misfired round passes through the trap door, such trap door is immediately closed and latched until the sensor is again operated.

Just prior to the point of intersection between the cradle conveyor 45 and the feed conveyor 76, the lugs 57 of the cradle conveyor links 56 enter the grooves of the lower tracks 60 so that the lower run of the cradle conveyor 45 is guided rearwardly of the housing 35. When the split cradles of the cradle conveyor remove the empty shell casings from the feed conveyor 76, the extractor groove 62 of each of the casings is engaged by the ridges 61 of the short sections 48 of the split cradles 46 and the butt ends of the shell casings are supported by the lower guide 66 to cause the shell casings to follow a straight path toward the rear of the housing. Simultaneously, the tubes 27, which are engaged by the elongated sections 47 of the split cradles 46 and supported by the lower guide bars 72, are automatically aligned with the shell casings. As the lower run of the cradle conveyor moves through the housing, the annular grooves 68 of such tubes 27 engage the lower cams 70 which causes the tubes to be shifted axially along the split cradles toward the shell casings 63 so that the tubes are moved to a position surrounding the empty shell casings, so illustrated best in the lower portion of FIG. 5. This axial movement of the tubes 27 causes the shell casings to be inserted into such tubes.

At the discharge end of the cradle conveyor, the belt 26 passes over a star wheel 94 and then along a ramp 95 into the surge chamber 38. From the surge chamber the belt passes through the flexible chute 37 and into the belt handling apparatus 30 carried by the transport vehicle 20.

With particular reference to FIGS. 1 and 11–13, the belt handling apparatus 30 is normally divided into two generally parallel compartments or sections with the first section being located above an ammunition box 24 in which a belt 26 having tubes filled with live rounds of ammunition is located, and the second section being positioned above an empty ammunition box. The sprocket mechanism 31 is disposed within the first section and is used for removing a belt of ammunition from the first box. The flaker mechanism 32 is located in the second section and is adapted to receive the belt after the empty shell casings 62 have been inserted in the tubes 27. The flaker mechanism moves back and forth through the belt handling apparatus to flake the belt within the ammunition box or to arrange the belt in tiers extending the full length of the ammunition box in a manner to be described later.

The sprocket mechanism 31 includes a plurality of sprockets 97 adjustably fixed on a shaft 98 the opposite ends of which are rotatably supported by bearings carried by pillow blocks 99. In order to drive the sprockets to raise the belt out of the ammunition box, one end of the shaft 98 is provided with a driven gear 100 which meshes with a drive gear 101 mounted on a shaft 102. The shaft 102 is connected by a coupling 103 to an angle drive gear box 104 which in turn is connected to one end of a flexible drive shaft 105. The opposite end of the flexible drive shaft 105 is attached to any desired source of power such as, for example, a power take-off from the gear box 43 carried by the housing 35.

The flexible drive shaft 105 rotates at a substantially constant speed which is sufficient to rotate the sprockets 97 in synchronization with the speed of the cradle conveyor 45 to cause the belt to be removed from the filled ammunition box at the same speed that such belt is moved along the cradle conveyor.

The flaker mechanism 32 which is located in the second section of the belt handling apparatus 30 includes an elongated cross-threaded multiple-return lead screw 106 extending lengthwise of the ammunition box and such lead screw is supported by bearings 107. One end of the lead screw is connected to one end of a flexible drive shaft 108, the opposite end of which is connected to a source of power such as a power take-off from the gear box 43 located within the housing 35. Since the transport vehicle 20 and the ammunition transfer vehicle 21 can be moved independently, the end of the flexible drive shaft 108 is connected to the lead screw 106 by a quick disconnect connection of conventional construction.

A pair of elongated rails 109 extend lengthwise of the belt handling mechanism with one of such rails being located above and in spaced relationship to the lead screw 106. A carriage 110 is mounted on the rails 109 and such carriage includes a pair of slide housings 111 and 112 having a plurality of longitudinally aligned ball bearings. The slide housing 111 is provided with a stub shaft 113 mounted in ball bearings 114 and such stub shaft is connected by a constant torque clutch 115 to a shaft 116, the opposite end of which is mounted in bearings within the slide housing 112. A plurality of sprockets 117 are mounted on the shaft 116 and such sprockets are of a size to receive the tubes 27 of the belt 26 so that when the shaft 116 is driven, the sprockets pull the belt 26 through the flexible chute 37.

In order to move the carriage 110 back and forth through the belt handling apparatus, the slide housing 111 has a downwardly extending tang 118 which is slidably received within the threads of the lead screw 106. When the lead screw 106 is rotated by the drive shaft 108 in a constant direction, a first set of threads on the lead screw cause the carriage 110 to be advanced from the front of the belt handling apparatus toward the back. At the back of the lead screw, the tang is automatically transferred to the cross-threads so that the carriage is returned to the front of the belt handling apparatus. At the completion of the return traverse, the tang 108 is automatically inserted into the first threads and the back-and-forth operation of the carriage is repeated.

In order to rotate the shaft 116 in a constant direction as the carriage 110 moves back and forth along the rails 109, the stub shaft 113 of the slide housing 111 is connected to a pinion gear 119 by means of a one-way roller clutch 120 and is connected to a second pinion gear 121 by a one-way roller clutch 122 that is in the reverse direction from the roller clutch 120. The pinion gear 119 meshes with a toothed rack 123 which is fixed to the lower portion of the frame of the belt handling apparatus and the pinion gear 121 meshes with a toothed rack 124 mounted on the upper portion of the frame of the belt handling apparatus.

When the carriage 110 is moving from front to rear of the belt handling apparatus, the roller clutch 120 connects the pinion gear 119 to the shaft 116 to drive the shaft and the sprockets 117 in a direction to pull the belt 26 from the housing 35 and discharge such belt into the ammunition box 24 immediately below the flaker mechanism. During this movement the pinion gear 121 is freely rotatable on the roller clutch 122. When the carriage 110 reaches the end of the lead screw 106 and begins movement toward the front, the roller clutch 120 becomes disengaged and the roller clutch 122 connects the pinion gear 121 to the shaft 116 and continues driving the shaft 116 in the same direction.

The cradle conveyor 45 discharges the belt 26 at a constant rate of speed onto the ramp 95 which leads to the surge chamber 38. The sprockets 117 are rotated by the pinion gears 119 and 121 at a speed such that the surface speed of the belt within the flaker mechanism 32 is the same as the surface speed of the belt within the cradle conveyor. However, due to the movement of the carriage 110 along the rails 109, when the carriage is moving from front to rear, the belt is withdrawn from the surge chamber at a rate faster than the belt is entering such surge chamber so that substantially all of the slack within the surge chamber is taken out of the belt during the front to rear movement of the carriage. When the carriage 110 reverses direction and moves from rear to front, the belt is withdrawn from the surge chamber at a speed less than the speed at which the belt is being discharged into the surge chamber which causes a loop to be formed in the surge chamber. When the carriage again reverses direction and travels from front to rear, the slack loop is removed from the surge chamber.

The back-and-forth movement of the carriage 110, while the sprockets 117 are rotating at a constant speed, causes the belt with the empty shell casings to be deposited in layers along the entire length of the ammunition box. Since the tubes are connected by flexible webs or connectors, the tubes of the first layer in the ammunition box are equally spaced along the bottom wall of the box and in each subsequent layer the tubes are staggered relative to the next adjacent lower layer so that the tubes of each upper layer are located between and supported by two adjacent tubes of the next adjacent lower layer. The back-and-forth flaking or positioning of the belt causes an even build-up within the ammunition box and utilizes the available space therein in an efficient manner.

In the operation of the device, when a military aircraft returns to its base, the transport vehicle 20, having three filled ammunition boxes 24 and one empty box mounted thereon, and the ammunition transfer vehicle 21 are moved to a position adjacent to the armament system access door of the aircraft. After such door has been opened, the interface or load head unit 41 is attached to a cooperating interface of the aircraft armament system. The flexible drive shaft 42 is connected to the power plant of the aircraft armament system and the flexible drive shafts 105 and 108 which are mounted on the transfer vehicle 21 are connected to the belt handling apparatus 30 carried by the transport vehicle 20. A belt 26 from within a filled ammunition box is fed onto the sprockets 97 of the sprocket mechanism 31 within the belt handling apparatus 30 after which the power plant of the aircraft is energized to cause the belt, which is filled with live rounds of ammunition, to pass through the flexible chute 36 into the housing 35 and along the ramp 73 leading to the cradle conveyor 45 where the belt is engaged by the idler star wheel 67.

The belt is fed onto the horizontally disposed split cradles 46 of the cradle conveyor in such a manner that the extractor grooves 63 of the rounds of ammunition engage the arcuate ridge 64 fixed on the short sections 48 of the cradles. As the belt is moved through the housing 35 by the cradle conveyor 45, the upper cams 69 engage the annular grooves 68 of each of the tubes 27 and cause the tubes to be shifted axially away from the rounds of ammunition which are moving in a straight path until the tubes are completely removed from the ammunition.

As the separated belt and rounds of ammunition approach the cradle conveyor driver sprockets 52, the belt passes around such sprockets and returns along the lower run of the cradle conveyor, while the rounds of ammunition are intercepted by the feed conveyor 76 in such a manner that one round of ammunition is placed in each element 78 of the feed conveyor. The feed conveyor is twisted approximately 90° so that the rounds of ammunition are disposed along generally vertical axes and pass through the flexible chute 39 to the interface or load head unit 41. In the interface or load head unit 41, the live rounds of ammunition are transferred automatically to the conveyor elements of the aircraft armament system where they are moved to a ready storage chamber in the aircraft armament system.

Simultaneously, empty shell casings and misfired rounds or duds are removed from the aircraft armament system at the interface 41 and are placed in the now empty elements 78 of the feed conveyor 76 and such elements and empty casings pass through the flexible chute 40 to the housing 35. Within the housing the empty shell casings and the misfired rounds may pass a sensor which senses the presence of a misfired round and unlocks the trap door 89 while simultaneously energizing the shaft 90 so that the arm 91 is rotated to engage the misfired round, remove the same from its associated element 78 of the feed conveyor, and discharge such misfired round through the trap door into the armored compartment 93. If desired, the trap door 89 and the sensor, shaft 90 and arm 91 may be incapacitated, in which event the misfired rounds will not be discharged through the trap door, but instead will continue to move into the housing 35 along with the empty shell casings. Within the housing 35 the feed conveyor 76 passes between the split cradles 47 and 48 so that the shell casings 62, with or without a misfired round, are intercepted by the split cradles of the lower run of the cradle conveyor 45 and such cradles remove the casings from the feed conveyor in such a manner that the ridge 64 fixed to the short cradle section 48 engages the extractor groove 63 of each shell casing. As the lower run of the cradle conveyor moves the casings through the housing 35, the tubes 27 of the belt 26 are in engagement with the elongated sections 47 of the split cradles, while being supported by the lower guide bars 72, and are axially aligned with the shell casings 62. During the traverse on the lower run of the cradle conveyor, the annular grooves 68 of each of the tubes engage the lower cams 70 which causes the tubes to shift axially toward the shell casings until the shell casings are inserted into the tubes.

After the casings have been inserted into the tubes, the belt 26 is discharged from the housing 35 into the surge chamber 38 and passes through the flexible chute 37 to the flaker mechanism 32 within the belt handling apparatus 30. The flaker mechanism is driven by the flexible drive shaft 108 which rotates the lead screw 106 to move the carriage 110 back and forth along the rails 109. During the movement of the carriage 110 along the rails, the pinion gears 119 and 121 alternately drive the shaft 116 and the sprockets 117 in a constant direction regardless of the direction of movement of the carriage. The back-and-forth movement of the carriage pulls the belt 26 from the surge chamber 38 and deposits the belt into the empty ammunition box 24 carried by the transport vehicle. The back-and-forth movement of the carriage causes the belt to be flaked or arranged in layers within such ammunition box.

As soon as the first ammunition box has been emptied, the top 25 of the next adjacent ammunition box is removed and the belt handling apparatus 30 is shifted so that such belt handling apparatus is located above the new ammunition box, as well as the ammunition box which has just been emptied. The first tube 27 of the ammunition belt in the new box is attached by the webs 28 to the last tube of the first belt being introduced into the housing 35 and the operation continues until the armament system of the aircraft is completely filled. As soon as the aircraft armament system is filled, the flexible drive shaft 42 is removed from the aircraft power plant, the interface 41 is disconnected from the aircraft interface and the access door of the aircraft is closed so that the aircraft is ready to begin operation again.

In some cases, it is desirable to completely unload the armament system of the aircraft so that the aircraft can be reloaded with a different type of ammunition, depending upon the situation and the mission which the pilot is expected to undertake. For example, the aircraft may be loaded with armour piercing incendiary, high explosive incendiary or target practice projectiles, and it is desirable to change from one type to another. In this event, even if the aircraft returns to base with a full complement of ammunition, the uploading of the new ammunition and the downloading of the ammunition in the aircraft armament system can be accomplished in approximately 18 minutes or substantially the same amount of time required for refueling the aircraft.

I claim:

1. Apparatus for handling elongated slender articles which are generally cylindrical in cross-section, comprising first and second endless conveyor means, said first conveyor means including a plurality of article receiving members each having separate first and second sections spaced apart a predetermined distance, each of said first sections being in alignment with a cooperating second section, means for driving said first and second sections simultaneously, said cooperating sections each receiving an elongated slender article, said second conveyor means having a plurality of spaced article receiving elements, a portion of said second conveyor means being positioned between said first and second sections of said first conveyor means, means for driving said second conveyor means in synchronization with said first conveyor means, said article receiving members of said first conveyor means and the article receiving elements of said second conveyor means being arcuate in cross-section and generally complementary to the cross-sectional configuration of said articles, and said article receiving elements of said second conveyor means intercepting the articles carried by said article receiving members of said first conveyor means so that said elements of said second conveyor means remove the articles from said members of said first conveyor means.

2. The structure of claim 1 and means for placing articles on said cooperating sections of said first conveyor, said means for placing articles including belt means having a multiplicity of containers flexibly connected together, each of said containers supporting an article in a manner that the article extends outwardly of one end of each container, means on said first section of each article receiving member for engaging the outwardly extending ends of said articles, and cam means located adjacent to said first conveyor means and engageable with said containers for moving said containers axially away from said articles.

3. Apparatus for handling rounds of ammunition having a generally cylindrical cross-sectional configuration and an extractor groove adjacent to one end, comprising a housing having a frame, a first endless conveyor having upper and lower runs mounted on said frame, said first conveyor including a plurality of spaced generally parallel ammunition receiving members, each of said receiving members including separate first and second sections spaced apart from each other a predetermined distance, means for placing a round of ammunition on each receiving member of the upper run of said first conveyor, said first section of each of said receiving members having a ridge for engaging the extractor groove of a round of ammunition, a second endless conveyor having upper and lower runs with portions positioned between said first and second sections of said first conveyor adjacent to one end, said second conveyor including a plurality of spaced ammunition receiving elements, the movement of the upper run of said second conveyor being synchronized with the movement of the upper run of said first conveyor so that the ammunition receiving elements of said second conveyor are at least momentarily axially aligned with the receiving members of said first conveyor and cause said elements to remove rounds of ammunition from said receiving members and means for driving said first conveyor and said second conveyor in synchronization with each other.

4. The structure of claim 3 including guide means mounted on said frame in spaced overlying relationship with said ridges for slidably engaging the rounds of ammunition and retaining the rounds on said ridges.

5. The structure of claim 3 in which each of said first and second sections of said ammunition receiving members includes an arcuate portion having a cross-sectional configuration generally complementary to the cross-sectional configuration of the rounds of ammunition.

6. The structure of claim 3 in which said first section of each of said ammunition receiving members is substantially shorter than said second sections.

7. The structure of claim 3 in which said means for placing ammunition on said receiving members includes an elongated belt having a multiplicity of containers flexibly connected in spaced side-by-side relationship, the extractor groove of each round of ammunition extending outwardly from one end of each container, cam means located adjacent to the upper run of said first conveyor for engaging said containers and moving said containers axially away from said rounds of ammunition while said ridges retain the round of ammunition in position on said first section.

8. The structure of claim 7 in which said housing is mounted on an ammunition transfer vehicle which can be moved to a position adjacent to a military aircraft having an armament system.

9. The structure of claim 8 in which said second conveyor includes an interface unit for discharging the rounds of ammunition from said elements of said second conveyor to the armament system of the aircraft and receiving spent ammunition shell casings and misfired rounds of ammunition from the aircraft which are placed on said elements.

10. The structure of claim 9 in which the lower run of said second conveyor intercepts the lower run of the first conveyor so that said receiving members of said first conveyor remove the spent shell casings from said elements of said second conveyor.

11. The structure of claim 10 including cam means located adjacent to the lower run of said first conveyor for engaging said containers and moving said containers axially onto the spent shell casings.

12. The structure of claim 8 including a transport vehicle positioned adjacent to said transfer vehicle and connected thereto by a pair of flexible chutes.

13. The structure of claim 12 in which said transport vehicle includes at least two ammunition boxes with one of said boxes containing said belt, a belt handling apparatus carried by said boxes, said belt handling apparatus including sprocket means for removing said belt from said ammunition box and discharging said belt through one of the flexible chutes onto the upper run of said first conveyor, and means for driving said sprocket means.

14. The structure of claim 13 in which said belt handling apparatus includes a flaker mechanism for receiving said belt from the lower run of said first conveyor and placing the same in tiers within the second ammunition box.

15. The structure of claim 14 in which said flaker mechanism includes a carriage slidably mounted on rails within said belt handling apparatus, sprocket means mounted on a shaft carried by said carriage, means for driving said carriage backward and forward along said rails, and means for driving said carriage sprockets in a constant direction as said carriage is moving back and forth.

16. The structure of claim 15 in which said means for driving said carriage includes an elongated cross-thread multiple return lead screw.

17. The structure of claim 15 in which said means for driving said carriage sprockets includes a pair of pinions connected to said sprocket shaft by roller clutches, one of said clutches being engageable when said carriage is moving backward and the other of said clutches being engageable when said carriage is moving forward.

18. The structure of claim 9 including means within said housing for discharging the misfired rounds of ammunition from the lower run of said second conveyor, said means for discharging misfired rounds including trap door means, an arm mounted on a selectively rotatable shaft and positioned adjacent to said trap door means, and means for selectively rotating said shaft, whereby when a misfired round is sensed said shaft is rotated to cause said arm to remove the misfired round from said elements of the lower run of said second conveyor and discharge the same through said trap door.

19. Apparatus for handling ammunition and loading the same into a military aircraft having an armament system, comprising a transport vehicle having at least two boxes thereon, one of said boxes being empty and the other box containing an ammunition belt including a multiplicity of interconnected containers each of which carries a round of ammunition having an extractor groove at one end, a belt handling apparatus mounted on said boxes, said belt handling apparatus having sprocket means located above said other box for removing said belt therefrom and flaker means located above said one box for subsequently discharging said belt into the same, an ammunition transfer vehicle adapted to be positioned adjacent to the military aircraft and adjacent to said transport vehicle, said transfer vehicle including an endless cradle conveyor having upper and lower runs, said upper run receiving said belt from said belt handling apparatus, said cradle conveyor having a plurality of cradles defining first and second portions in spaced aligned relationship with each other, said first portion of each cradle having means for engaging the extractor groove of a round of ammunition, cam means adjacent to said cradle conveyor for engaging said belt containers and moving said containers away from said rounds of ammunition, an endless feed conveyor having upper and lower runs, a portion of said feed conveyor located between said first and second portions of said cradle conveyor, said feed conveyor including a plurality of spaced ammunition receiving elements synchronized with the movement of said cradles of said cradle conveyor, said elements on the upper run of said feed conveyor receiving rounds of ammunition from the upper run of said cradle conveyor, said feed conveyor having an interface unit selectively connected to the armament system of the aircraft, said interface unit removing said rounds of ammunition from said elements of the upper run of said feed conveyor and discharging the same into said armament system while receiving spent shell casings from said armament system and inserting the same into said elements of the lower run of said feed conveyor, said elements of the lower run of said feed conveyor being synchronized with the cradles of the lower run of said cradle conveyor so that said cradles remove the spent casings from said elements, cam means adjacent to the lower run of said cradle conveyor for moving said belt containers axially onto said casings, and means for discharging said belt from said transfer vehicle to said flaker means of said belt handling apparatus.

* * * * *